US006409646B1

(12) United States Patent
Focke et al.

(10) Patent No.: US 6,409,646 B1
(45) Date of Patent: Jun. 25, 2002

(54) HINGE-LID BOX FOR CIGARETTES AND PROCESS AND APPARATUS FOR GLUING PACKAGING MATERIAL

(75) Inventors: Heinz Focke; Martin Stiller, both of Verden; Hermann Blome, Blender-Einste, all of (DE)

(73) Assignee: Focke & Co. (GmbH & Co), Verden (DE)

( * ) Notice: Subject to any disclaimer, the term of this patent is extended or adjusted under 35 U.S.C. 154(b) by 0 days.

(21) Appl. No.: 09/203,435

(22) Filed: Dec. 1, 1998

(30) Foreign Application Priority Data

Dec. 8, 1997 (DE) ..... 197 54 328

(51) Int. Cl.[7] ..... B31B 1/62

(52) U.S. Cl. ..... 493/7; 493/6; 493/131; 493/130; 493/128; 493/150

(58) Field of Search ..... 493/131, 130, 493/6, 333, 37, 7, 128, 150, 331, 264; 118/663, 676; 427/207.1

(56) References Cited

U.S. PATENT DOCUMENTS

| | | | | | |
|---|---|---|---|---|---|
| 3,541,930 | A | * | 11/1970 | Goodrich | 93/51 |
| 3,986,607 | A | * | 10/1976 | Focke | 206/245 |
| 4,048,950 | A | * | 9/1977 | Rakowicz et al. | 118/6 |
| 4,084,393 | A | | 4/1978 | Focke | 53/137 |
| 4,984,409 | A | * | 1/1991 | Focke | 53/53 |
| 5,113,638 | A | | 5/1992 | Focke et al. | 53/462 |
| 5,228,266 | A | | 7/1993 | Focke | 53/383.1 |
| 5,462,223 | A | | 10/1995 | Focke et al. | 229/160.1 |
| 5,613,932 | A | * | 3/1997 | Focke et al. | 493/128 |
| 5,656,084 | A | * | 8/1997 | Focke et al. | 118/314 |
| 5,906,087 | A | * | 5/1999 | Boldrini | 53/462 |

FOREIGN PATENT DOCUMENTS

| | | |
|---|---|---|
| CH | 476527 | 9/1969 |
| DE | AS1183351 | 12/1964 |
| DE | OS1817702 | 12/1969 |
| DE | 2548255 B2 | 5/1976 |
| DE | 4041599 A1 | 6/1992 |
| DE | 4241176 A1 | 6/1994 |
| DE | 4404721 A1 | 8/1995 |
| DE | 19604888 A1 | 8/1996 |
| DE | 19639259 A1 | 3/1998 |
| EP | 0275337 | 7/1988 |
| EP | 0804971 | 11/1997 |
| EP | 804 971 A1 | 11/1997 |
| FR | 2253676 A1 | 12/1974 |
| GB | 1173966 | 12/1969 |

* cited by examiner

*Primary Examiner*—Rinaldi I. Rada
*Assistant Examiner*—Sameh Tawfik
(74) *Attorney, Agent, or Firm*—Abelman, Frayne & Schwab

(57) ABSTRACT

In the production of hinge-lid boxes for cigarettes, outer side tabs (19) and lid side tabs (25) are folded last of all in order to form side walls of the hinge-lid box (10). The side tabs (19) and lid side tabs (25), extending in a horizontal plane, are to be provided with glue on the underside. For this purpose, glue nozzles (41, 42) are arranged in the region of a pack conveyor path (30) and have the side tabs (19) and lid side tabs (25) butting against them temporarily for the transfer of strip-like applications of glue.

9 Claims, 8 Drawing Sheets

HINGE-LID BOX FOR CIGARETTES AND PROCESS AND APPARATUS FOR GLUING PACKAGING MATERIAL

BACKGROUND OF THE INVENTION

The invention relates to a hinge-lid box for cigarettes, comprising a box part and lid, which have side tabs and lid side tabs which are connected to one another by glue and are intended for forming side walls of the box part and of the lid. The invention also relates to a process and apparatus for gluing packaging material, namely material webs, blanks or folding tabs of not-yet finished packs, during the production of these packs.

The gluing region for packaging material, in particular blanks made of paper or (thin) cardboard, in order to connect folding tabs to one another or to other parts of the pack is a sensitive region of a packaging machine. In particular in the case of packaging machines for cigarettes, the operation of applying glue to blanks poses problems due to the high output of such packaging machines and the short cycle times which result therefrom.

In the production of hinge-lid boxes (hinge-lid packs), applications of glue are to be applied to a plurality of regions of the thin-cardboard blanks. It has already been proposed for spot-like applications of glue to be applied to the non-folded, that is to say planar, blanks from above by glue nozzles producing spots of glue at selected positions by way of short spraying or injecting cycles.

In order to form side walls of the box part and of the lid of this type of pack, folding tabs, namely in each case inner and outer side tabs and lid side tabs, are to be connected to one another by glue. During an end phase of the production of the hinge-lid box, outer side tabs and lid side tabs are directed sideways in a horizontal position and have the inner side which is to be glued oriented downwards. Up until now, these outer side tabs and lid side tabs have been glued by glue wheels or glue discs, which are provided with a layer of glue on the outer circumference and transfer strip-like applications of glue by butting against the folding tabs during transportation of the packs. The glue discs or wheels form part of a glue assembly which, since it operates as has been described, requires a high level of maintenance and, moreover, is susceptible to malfunctioning.

SUMMARY OF THE INVENTION

The object of the invention is to propose measures for reliable, malfunction-free transfer of complex applications of glue to packaging material, with the packaging machine having a high output capacity.

In order to achieve this object, the hinge-lid box according to the invention is configured, as far as the formation and arrangement of applications of glue in the region of side walls and lid side walls are concerned, such that the (outer) side tabs and lid side tabs are connected to one another by narrow, continuous strips of glue running in the longitudinal direction of said tabs, preferably by in each case two parallel strips of glue.

The prior-art applications of glue in the region of the abovementioned folding tabs are designed such that the application of glue is constituted by rectangular areas of glue in a row. This structure of the application of glue is achieved as a result of the configuration and operation of the glue discs, or glue wheels, provided with corresponding depressions. Instead, the invention forms thin, uninterrupted, that is to say continuous, strips of glue.

An important issue of the invention is the application of the preferably strip-like applications of glue to the folding tabs of the blanks or not-yet finished packs, but also to non-folded blanks or continuous material webs. The process according to the invention is characterized in that preferably strip-like applications of glue are transferred onto the packaging material—material web, blank or folding tabs of not-yet finished packs—by relative movement with respect to a glue dispenser, in particular glue nozzles, the packaging material butting against a glue dispenser in the region of the glue transfer.

Accordingly, in the case of the process according to the invention, applications of glue, in particular strips of glue, are transferred by contact with the packaging material with the mouth of a glue nozzle, the packaging material being in contact with the nozzle mouth as it is drawn beyond the glue nozzle, which is preferably fixed. The limitation of the application of glue in the movement direction of the packaging material is defined by the opening phase of the glue nozzle or by the duration of the feed of glue. Accordingly, the glue nozzle is controlled in terms of the opening phase or in terms of the feed of glue, to be precise in dependence of the speed of the packaging material, on the one hand, and on the sought-after dimension of the strip of glue in the movement direction, on the other hand.

A process-specific special feature is realized when the packaging machine is operated at diminished cycle rates, in particular when the packaging machine is started up. During this operating state, the glue assembly is driven in a cyclic manner, i.e. glue is fed to the glue nozzles in a intermittent or pulsed manner. For this purpose, a valve or shut-off element, which can be controlled in the corresponding pulsed or intermittent manner, is arranged in a glue line which supplies the glue nozzle.

Furthermore—depending on the operating state of the packaging machine—the feed of glue can be regulated by altering the pressure acting on the glue. A relatively low pressure is exerted on the glue in the case of a relatively low conveying speed of the packaging material and a relatively high pressure is exerted on the glue in the case of a correspondingly higher conveying speed, this pressure being exerted preferably by a pump for the feed of glue.

The apparatus according to the invention for gluing packaging material, in particular blanks, comprises a stationary glue assembly in the movement path of the packaging material, to be precise beneath said movement path. The glue assembly comprises preferably a plurality of nozzles for applying a plurality of parallel strips of glue, it being the case that the packaging material moves via the upwardly directed nozzle mouths and can be pressed against the nozzle mouths by a pressure-exerting element at least during the glue transfer.

Further details of the invention relate to the process for applying glue and to details of the apparatus, including a monitoring unit for checking the correct formation of the applications of glue. An exemplary embodiment for the configuration of a blank and details of the apparatus are explained in more detail hereinbelow with reference to the drawings, in which:

DETAILED DESCRIPTION

Figure 1:
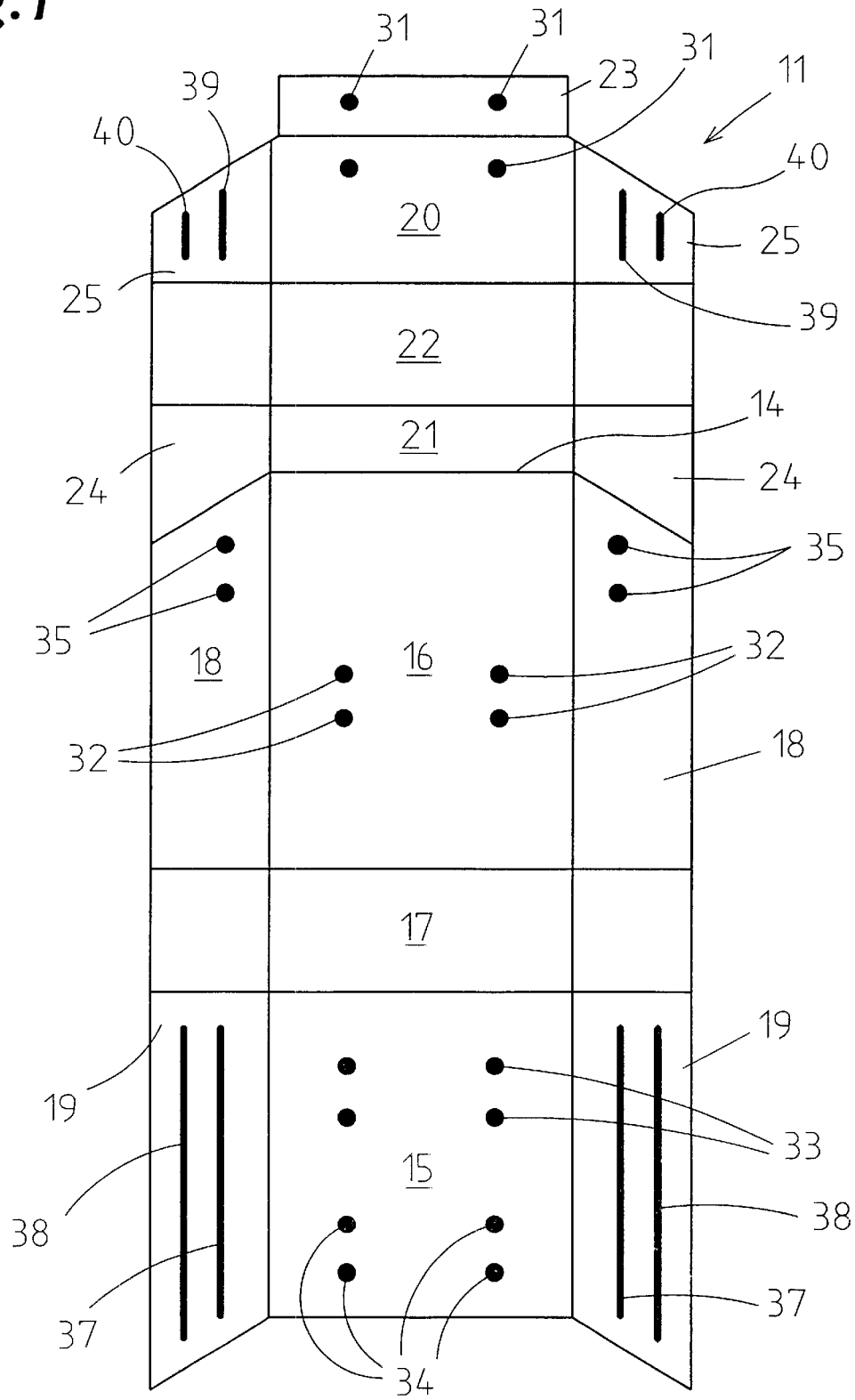
FIG. 1 shows a spread-out blank for a hinge-lid box.
Figure 2:
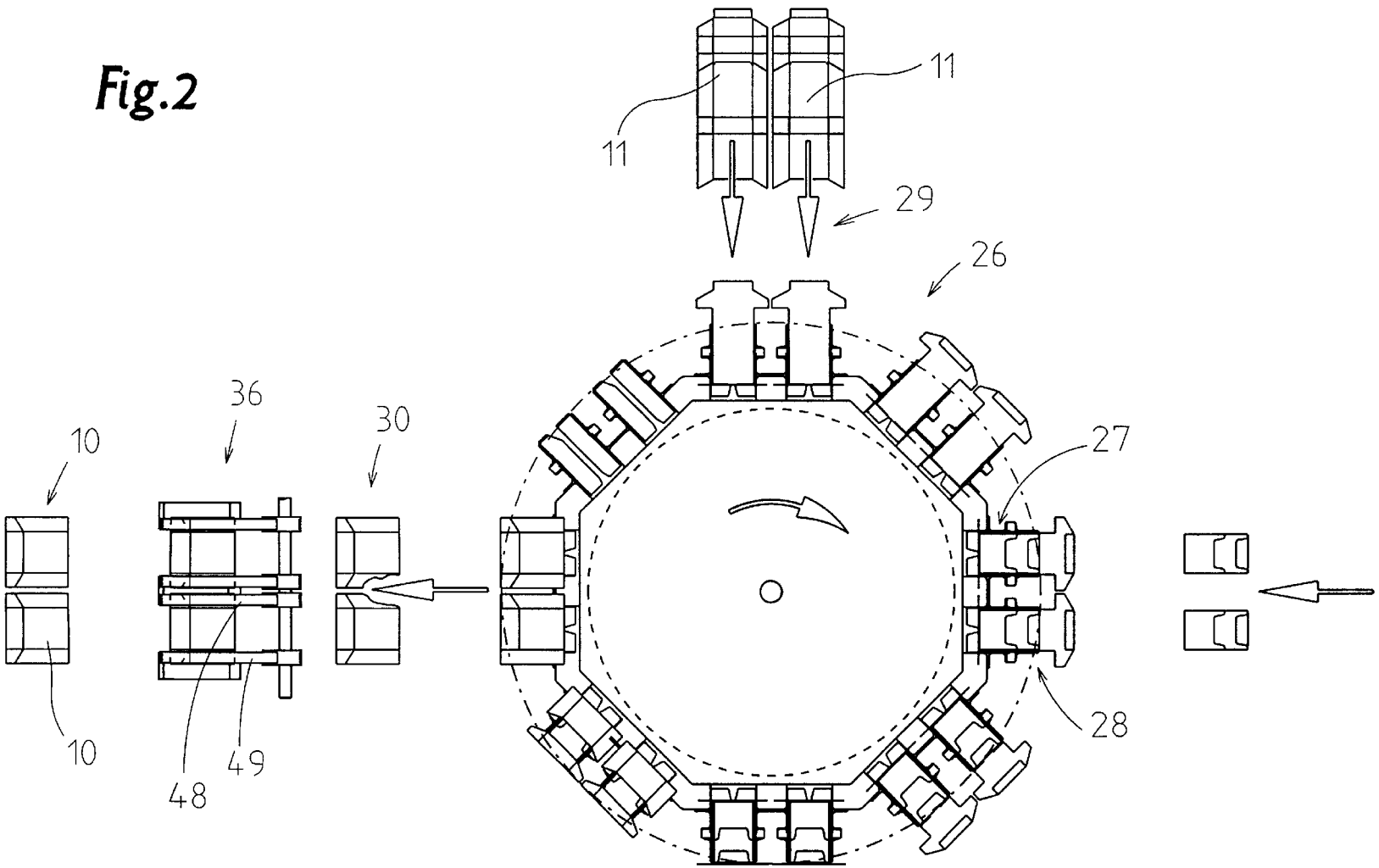
FIG. 2 shows a simplified plan view of part of a packaging machine for producing hinge-lid boxes.
Figure 3:
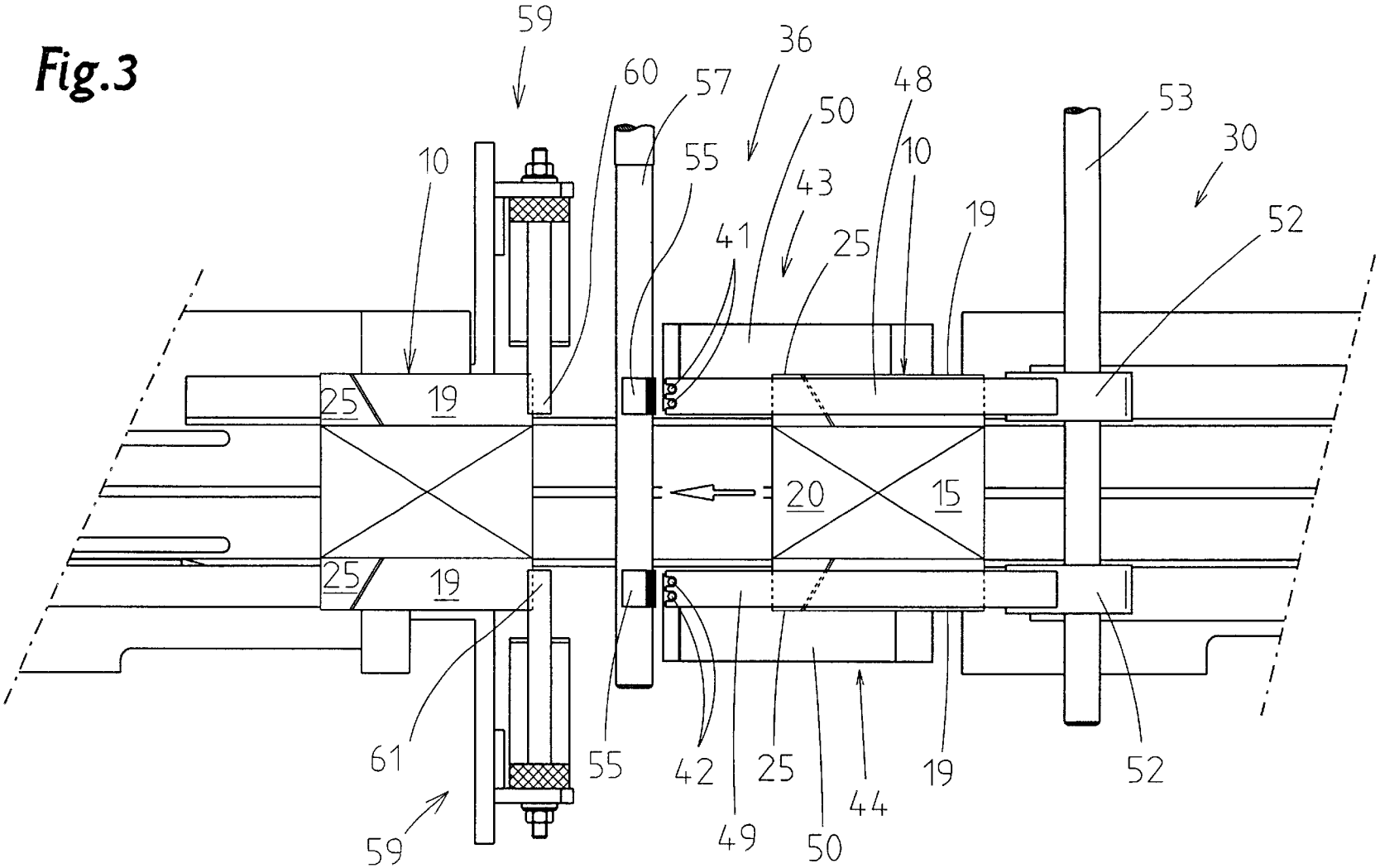
FIG. 3 shows, on an enlarged scale, the plan view of a region of a pack conveyor path with glue assembly.

The details illustrated in the drawings relate to the production and gluing of hinge-lid boxes 10 and the blanks 11 thereof.

A hinge-lid box 10 typically comprises a box part 12 and a lid 13. The latter is connected to the box part 12 in an articulated manner, namely via an articulation line 14.

The box part 12 comprises a front wall 15, rear wall 16 and base wall 17. Side walls are of double-layered design, that is to say they comprise inner side tabs 18 and outer side tabs 19. The side tabs 18 and 19 butt against one another in order to form the narrow, upright side walls in each case and are connected to one another by adhesive bonding.

The lid 13 is designed correspondingly with a lid front wall 20, lid rear wall 21 and end wall 22. Provided on the free side of the lid front wall 20 is an inner tab 23 which is to be folded over against the inside of the lid front wall 20.

Lid side walls likewise comprise inner lid side tabs 24 and outer lid side tabs 25. It is also the case that the lid side tabs 24 and 25 overlap one another and are adhesively bonded to one another in order to form lid side walls.

Hinge-lid boxes 10 are produced in a folding turret 26 from blanks according to FIG. 1, said folding turret being designed, by way of example, according to U.S. Pat. No. 4,084,393. Unlike this known embodiment, the folding turret 26 is designed for two-track operation, with in each case pairs of pockets 27 and 28 for receiving in each case one blank 11 or one hinge-lid box 10.

The blanks 11 are fed (in pairs) to the folding turret 26 in the radial direction along a blank conveyor path 29. The more or less finished hinge-lid boxes 10 are introduced into a likewise radially directed pack conveyor path 30, which runs transversely with respect to the blank conveyor path 29. In the region of said pack conveyor path 30, the finishing touches are made to hinge-lid boxes 10 as they are transported.

The blank 11 is provided with glue in order to connect folding tabs and fix parts of the pack. In the region of the blank conveyor path 29, spots of glue are applied to the insides of the non-folded blank 11, to be precise spots of glue 31 are applied in the region of lid front wall 20 and inner tab 23 in order to connect the inner tab 23 to the lid front wall 20. Further spots of glue 32 are located in the region of the rear wall 16. The pack contents, namely an inner wrapper for a cigarette group, are fixed in this region. Further spots of glue 33 in the region of the front wall 15, adjacent to the base wall 17, likewise serve for fixing the pack contents, that is to say the inner wrapper. Spots of glue 34, which are likewise arranged in the region of the front wall 15, adjacent to a top closure edge of the pack, serve for fixing a collar, formed from a separate blank, as part of the hinge-lid box. In order to fasten the collar, namely collar side tabs, use is also made of spots of glue 35, which are located in the region of inner side tabs 18 of the box part. The spots of glue 31, 32, 33 and 34 are arranged in two rows of spots in each case, each row of spots, for the different functional regions, comprising two spots of glue in each case.

Problematic gluing of the blank 11 takes place once the more or less finished hinge-lid box 10 has been pushed out of the folding turret 26, namely in the region of the pack conveyor path 30. In this region, the hinge-lid box 10 is almost finished, apart from the fact that (just) the outer side tabs 19 and lid side tabs 25 have not been folded, that is to say they extend in a horizontal plane. In this case, the hinge-lid boxes are transported in the region of the pack conveyor path 30 at a distance from one another, such that the side tabs 19 and lid side tabs 25 are directed in a wing-like manner to both sides in a top pack plane. Accordingly, the front wall 15 and lid front wall 20 are directed upwards. The inner sides of the side tabs and lid side tabs 25 to be glued are thus oriented downwards.

In the region of the pack conveyor path 30, the outer side tabs 19 of the box and lid outer side tabs 25 are guided through a glue assembly 36 and glued in the region of the same. In this case, particular applications of glue, namely, thin parallel strips of glue 37, 38 and 39, 40 running in the longitudinal direction, are applied to the folding tabs. The strips of glue 37, 38, 39, 40 are narrow, continuous, that is to say uninterrupted, areas of glue with a width of, for example, 1 mm to 2 mm.

Once the strips of glue 37, 38, 39, 40 have been applied, the outer box side tabs 19 and outer lid side tabs 25 are folded over until they butt against, and are connected to, the associated inner box side tabs 18 and inner lid side tabs 24. The hinge-lid box 10 is thus in the finished state.

The configuration of the glue assembly 36 and the way in which it operates constitute a special feature. The blanks 11 or hinge-lid boxes 10 are moved via glue dispensers and held temporarily in contact therewith such that, by way of the movement of the hinge-lid boxes 10 or blanks 11, glue is transferred to the folding tabs from beneath. The length of the applications of glue or strips of glue 37, 38, 39, 40 results from the duration over which the blank 11 is pressed against the glue dispenser or from the duration of the feed of glue to said glue dispenser, with the conveying speed of the blanks being taken into account.

The glue dispensers are glue nozzles 41, 42, these being glue-feeding openings with an upwardly directed mouth.

For the transfer of glue by way of the glue nozzles 41, 42, the blanks 11 or folding tabs of the hinge-lid boxes 10 butt against the glue nozzles 41, 42 or against the mouths thereof. As a result of the contact with the glue nozzles 41, 42 and the relative movement of the blanks 11, a strip-like application of glue is transferred. The width of the strips of glue 37, 38, 39, 40 is given by the diameter of the glue nozzles 41, 42 or of the mouths. The length of the strips of 37, 38, 39, 40 can be determined by the duration over which the blanks 11 butt against the glue nozzles 41, 42 or—as in the present case—by the duration of the feed of glue to the glue nozzles 41, 42. In order to end the transfer of glue to the blank 11, the feed of glue to the glue nozzles 41, 42 is interrupted by a correspondingly controllable shut-off element.

For each side of the hinge-lid box 10, or on both sides of the pack conveyor path 30, there is arranged an independent gluing unit 43, 44. Each gluing unit 43, 44 supplies two adjacent glue nozzles 41, 42 for applying the two strips of glue 37, 38 and 39, 40. The glue is fed to the two glue nozzles 41, 42 of each gluing unit 43, 44, via glue lines 45, 46, from a central glue supply (not shown). Arranged in each glue line 45, 46 is a shut-off element or a valve 47, which is controlled in time with the packaging machine. Accordingly, the feed of glue to each glue nozzle 41, 42 can be controlled individually, to be precise via the valve 47 assigned to each glue nozzle 41, 42. The length of the strips of glue 37, 38, 39, 40 is determined by the open and closed positions of the valve 47, with the result that, as is shown in FIG. 1, strips of glue 37, 38, 39, 40 of different lengths can be transferred by the glue nozzles 41, 42.

For optimum glue transfer to the blanks 11 or hinge-lid boxes 10, the blanks 11 or folding tabs are pressed (elastically) against the glue nozzles 41, 42. In the region of the glue assembly 36, pressure-exerting elements are assigned to the glue nozzles 41, 42. In the present exemplary embodiment, these are elastically deformable, strip-like pressure-exerting plates 48, 49. These extend, in the region of the side tabs 19, 25, above the movement path of the latter and in the conveying direction. The pressure-exerting plates 48, 49 are designed an arranged such that they are inclined downwards in the conveying direction. This produces, for the blanks 11, an inlet angle which decreases in the conveying direction. In the region of the glue nozzles 41, 42, and in front of this region, the pressure-exerting plates 48, 49 butt against lateral guides, namely against guide rails 50 on both sides of the movement path of the hinge-lid boxes 10. The guide rails 50 run in the region of the side tabs 19, 25. The latter rest on the top side of the guide rails 50 and thus, during the conveying movement, pass temporarily into a position between the guide rail 50 and pressure-exerting plate 48, 49.

The glue nozzles 41, 42 are arranged in the region of the guide rails 50, to be precise adjacent to the end of the same. The pressure-exerting plates 48, 49 are dimensioned such that they extend beyond the glue nozzles 41, 42 in the conveying direction, that is to say they grip, and exert pressure on, the top side of the blanks 11 in the region of the glue nozzles 41, 42 as well. In order that, when there are no blanks 11 or hinge-lid boxes 10 present, the pressure-exerting plates 48, 49 do not butt directly against the glue nozzles 41, 42, U-shaped recesses 51 are provided at the ends of the pressure-exerting plates 48, 49—in the region of the glue nozzles 41, 42—with the result that the glue nozzles 41, 42 are exposed.

Figure 4:
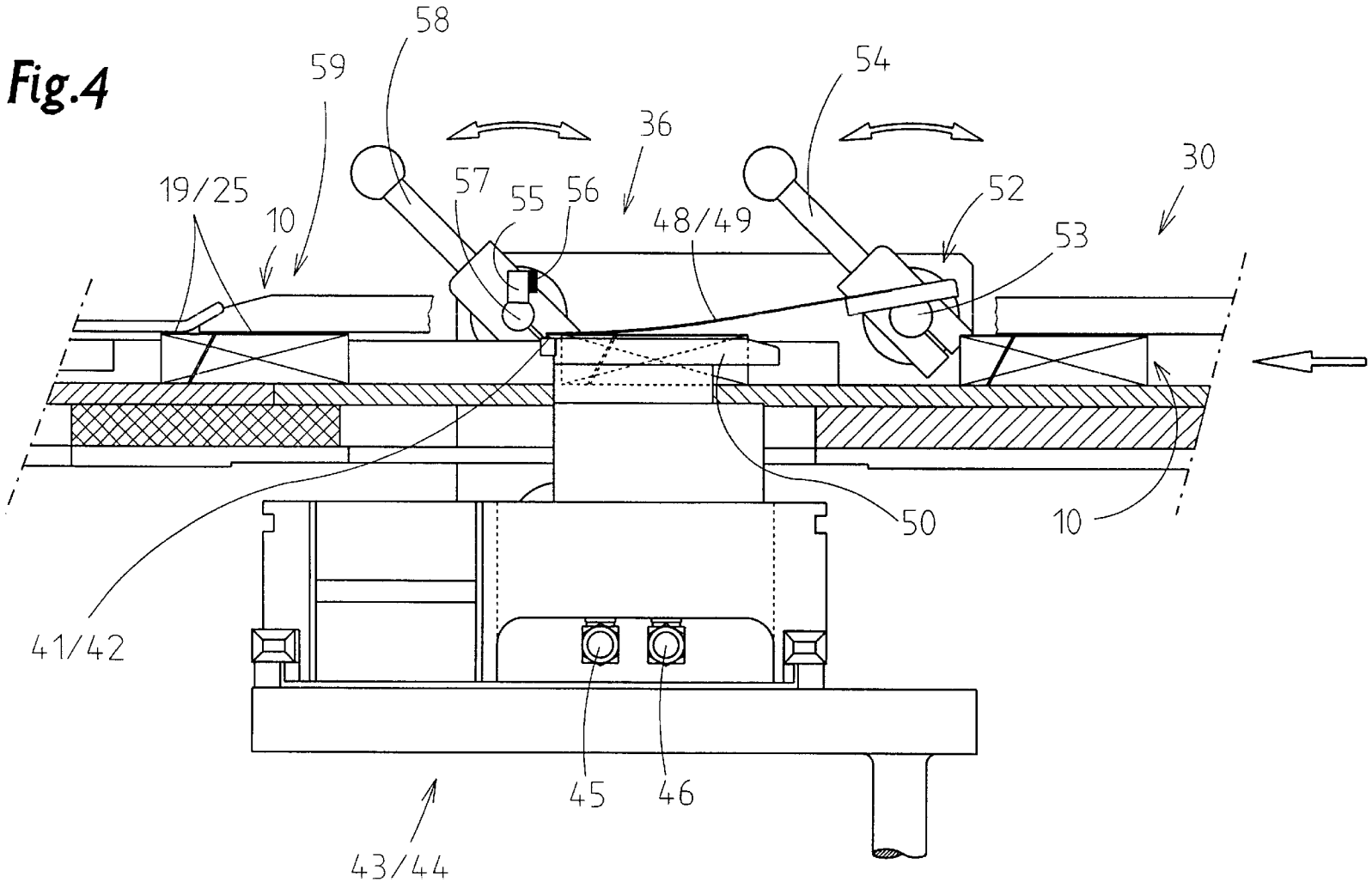
FIG. 4 shows the detail according to FIG. 3 in side view and in longitudinal section.
Figure 5:
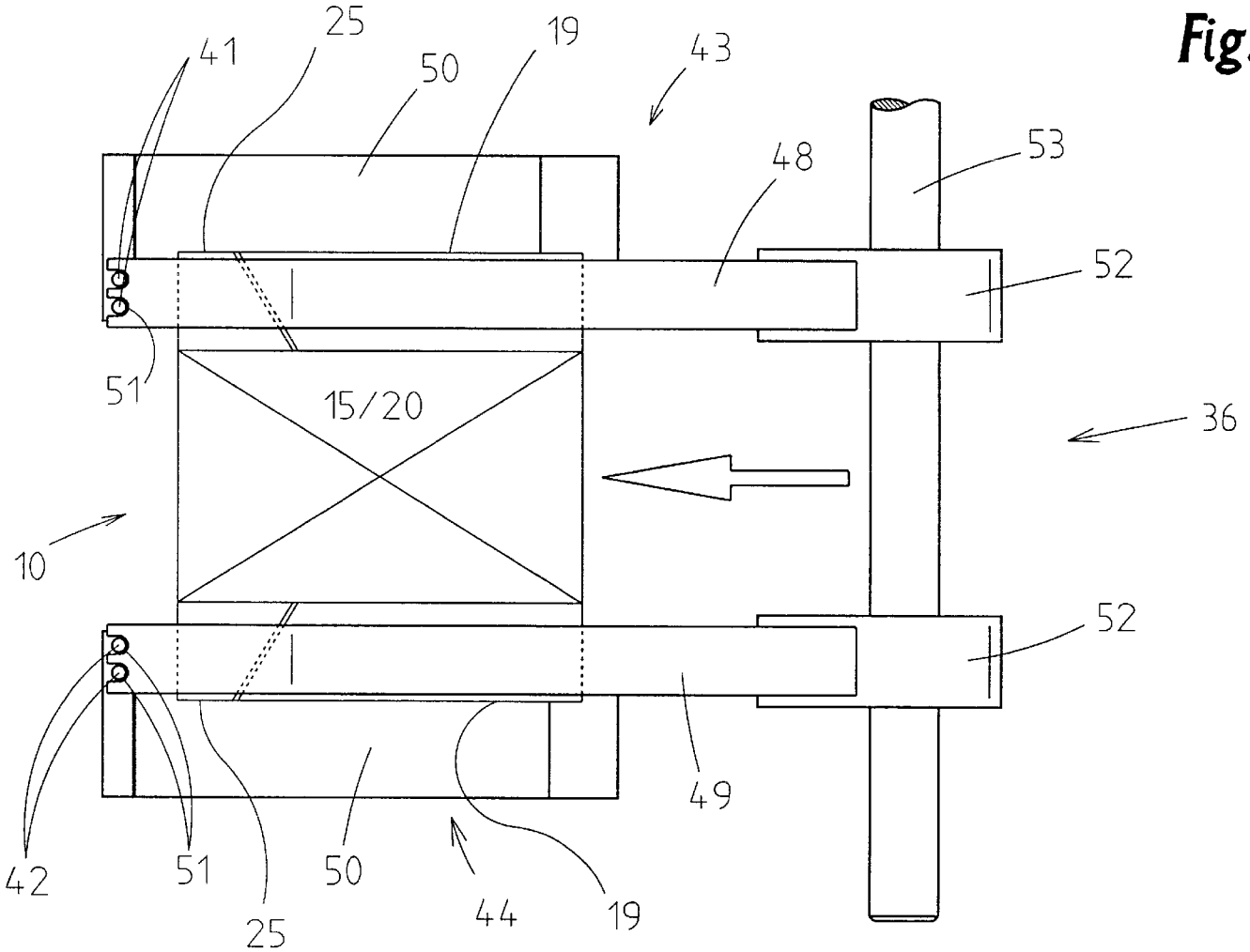
FIG. 5 shows, in a further-enlarged scale, a plan view of a glue assembly.
Figure 6:
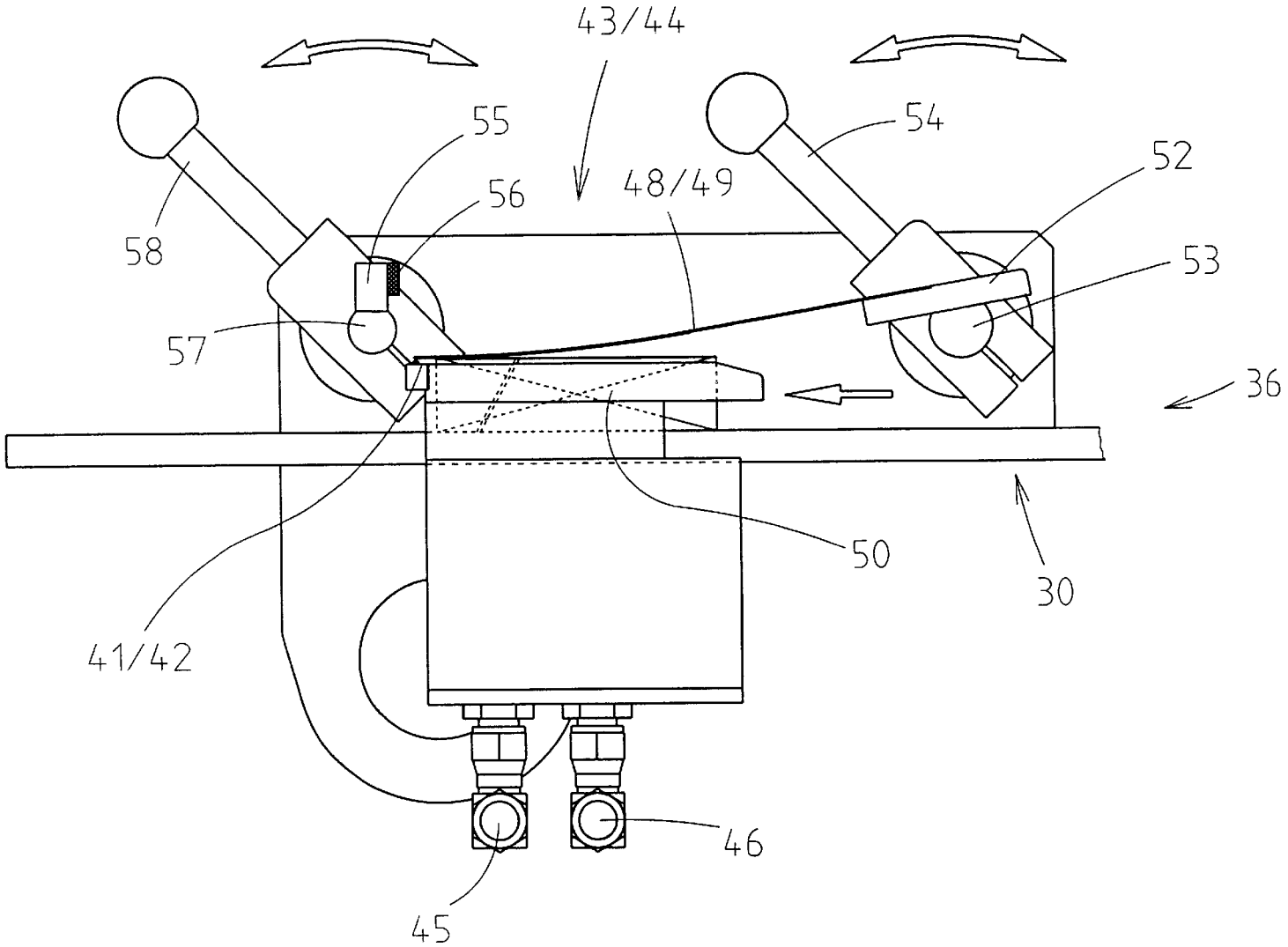
FIG. 6 shows a side view of FIG. 5.
Figure 7:
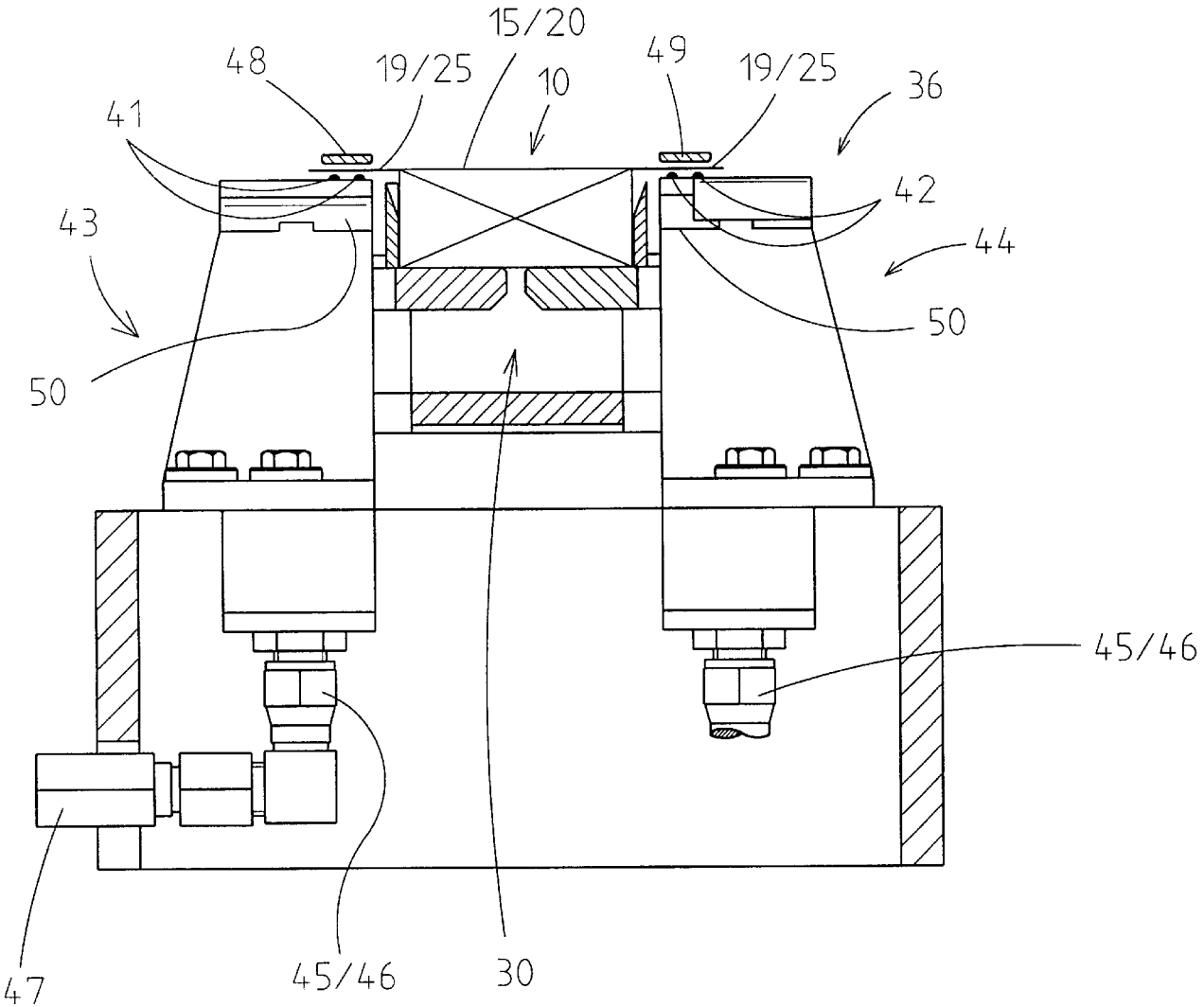
FIG. 7 shows a cross section through the glue assembly according to FIGS. 5 and 6.
Figure 8:
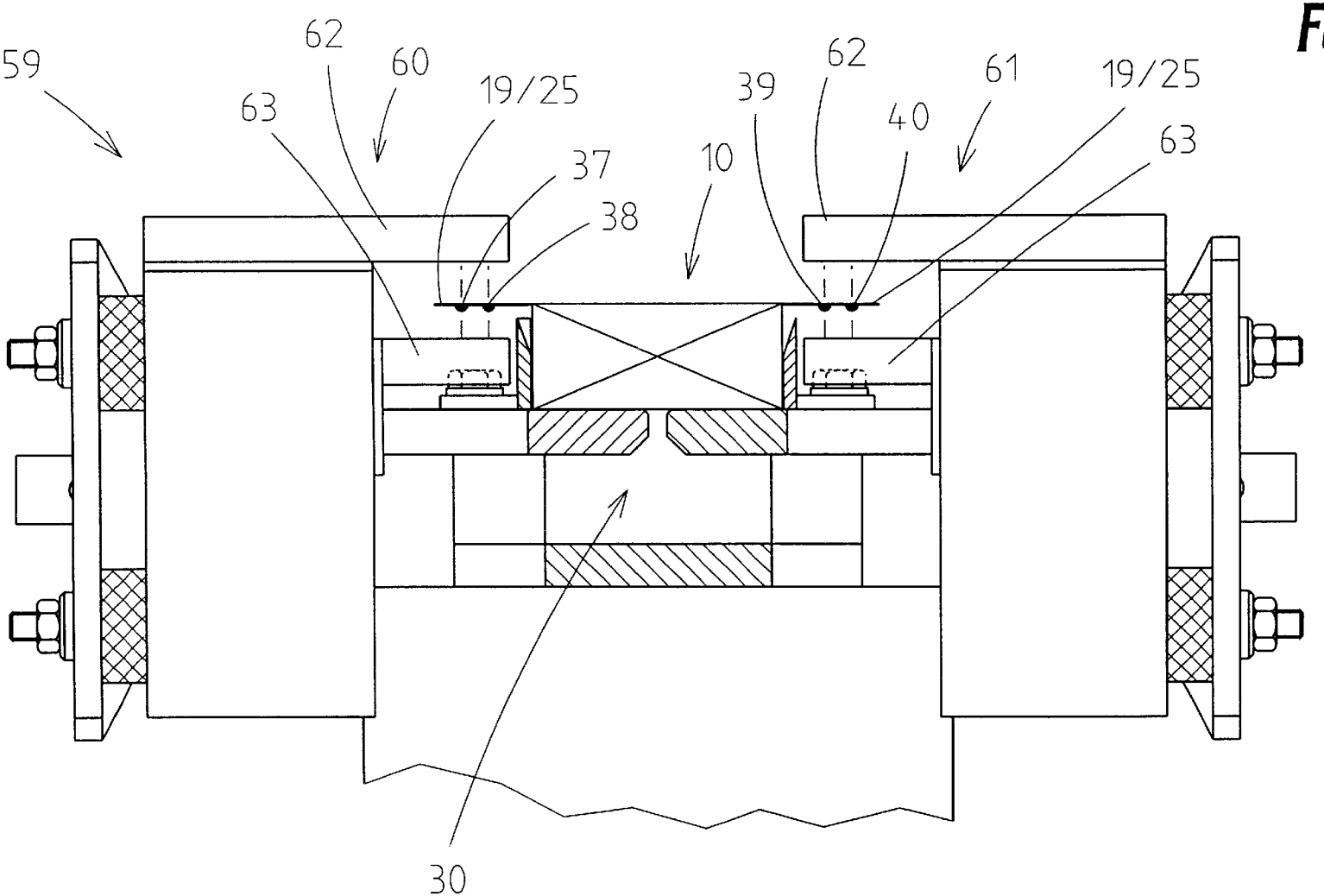
FIG. 8 shows a cross section in the region of a testing assembly.

The pressure-exerting plates 48, 49 are fastened on a mount 52 arranged above the movement path of the hinge-lid boxes 10. In the present example, this mount is designed such that the pressure-exerting plates 48, 49 can be moved out of the pressure-exerting position according to FIGS. 4 and 6 into a drawn-back, top position. For this purpose, the pressure-exerting plates 48, 49 are connected to a rotatable, transversely directed shaft 53 which can be rotated by a (hand) lever 54, as a result of which the pressure-exerting plates 48, 49 are pivoted.

In the drawn-back or pivoted-back position of the pressure-exerting plates 48, 49, the glue nozzles 41, 42, are expediently closed by a closure element butting against them from the outside, with the result that glue in the region of the glue nozzles 41, 42 cannot harden. In the present example, each pair of glue nozzles 41, 42 is assigned a closure member 55. The latter is of plate-like design and, in the region in which it butts against the respective glue nozzles 41, 42, is provided with an elastic sealing member 56, for example made of rubber. In the event of operation being interrupted for a relatively long period of time, the pressure-exerting plates 48, 49 are raised and the closure member 55 is moved into the closed position. For this purpose, the closure members 55 are provided on a common, transversely directed actuating shaft 57, which can be rotated via a (hand) lever 58 in order to move the closure members 55.

The correct arrangement and configuration of the applications of glue, in particular of the strips of glue 37, 38, 39, 40, is checked, following the glue station or the glue assembly 36, by a testing unit 59. The latter comprises two testing elements 60, 61, which are positioned on both sides of the pack conveyor path 30. Each testing element 60, 61 is of fork-shaped design with two legs 62, 63 aligned transversely with respect to the movement direction of the hinge-lid boxes 10. The legs 62, 63 are arranged at a distance one above the other such that those regions of the blanks 11 which are to be tested, in the present case the side tabs 19, 25, are moved through between the two legs 62, 63.

It is between the two legs 62, 63 of the testing elements 60, 61 that the blanks 11 are kept for the presence and/or the correct formation of the strips of glue 37, 38, 39, 40. Arranged, for this purpose, in the legs 62, 63 are sensors which interact in the region of the side tabs 19, 25 and react to the strips of glue 37, 38, 39, 40 (or to other applications of glue). These sensors are preferably ones which generate a capacitive electric field in the region between the legs 62, 63. Irregularities in the region of the strips of glue 37, 38, 39, 40 cause the capacitive field to change, to be precise, in particular, as a result of the moisture present in the strips of glue 37, 38, 39, 40. The change in the field is converted into a signal.

A further special feature is the control of the glue assembly 36. The length of the applications of glue or the dimension in the movement direction of the packaging material is determined in accordance with the opening duration of the glue nozzles 41, 42 or by the opening duration of the valve 47 in the glue feed. The feed of glue is further influenced during the operation of the machine, to be precise in accordance with the operating speeds and/or output. In this case, the glue pressure prevailing in the system of the glue assembly 36 or of the gluing units 43, 44 is changed. In the case of a relatively high speed of the packaging material or of the blanks, a correspondingly higher glue pressure is necessary than in the case of a relatively low conveying speed. For example, in the case of a low speed or machine output of 40 packs per minute, the pressure exerted on the glue is 1 bar. In the case of a maximum or standard output of the machine of, for example, 400 packs per minute, the system pressure is increased to 6.5 bar. For this purpose, a pump (not shown), which produces the pressure required in each case, is arranged in the glue feed.

A further special feature is put into practice when the packaging machine is started up or operated at a diminished number of cycles. The operating mode of the glue assembly 36 is adjusted to the operating state of the packaging machine. Until a certain minimum speed or machine output is reached, glue is fed to the applying element or the glue nozzles 41, 42 in a pulsed manner, that is to say with interruptions. For example, the packaging machine can be configured to operate at three different speeds, for example a minimum speed with a cycle rate of 40 packs per minute. During this operating state glue can be fed in portions at a cycle rate of 70 Hz, for example. At a medium speed of 200 packs per minute, glue can be fed to the glue nozzles 41, 42 in a pulsed manner at a cycle rate of 350 Hz, for example. At an even higher machine output level, a continuous flow of glue is conveyed under pressure. The amount of glue delivered can in addition, or alternatively, be influenced by adjusting the pressure acting on the glue, for example in the region of 1 bar to 3 bar of pressure.

The apparatus and process for applying strip-like applications of glue may also be used for non-folded blanks or for continuous material webs.

What is claimed is:

1. A process for manufacturing hinge-lid packs for cigarettes, each said pack being made from a blank having a pair of inner box side tabs on opposite sides of said blank, a pair of outer box side tabs on opposite sides of said blank, a pair of inner lid side tabs on opposite sides of said blank and a pair of outer lid side tabs on opposite sides of said blank, the process comprising the steps of:

providing a conveying path for said blanks, wherein a set of nozzles is disposed on each of opposite sides of said conveying path, each said set including two glue nozzles spaced apart transverse to said conveying path and directed upward for applying glue onto surfaces passing over said nozzles in contact therewith;

conveying said blanks with said tabs disposed over said glue nozzles;

feeding glue from said nozzles as said blank is conveyed relative thereto;

pressing said tabs into contact with said glue nozzles as said blank is conveyed relative thereto so as to effect the application by said glue nozzles of two narrow, continuous and parallel strips of glue onto said outer box side tabs and said outer lid side tabs; and folding said each said blank to bring said outer box side tabs into contact with said inner box side tabs and said outer lid side tabs into contact with said inner side tabs thereby to secure said respective inner and outer side tabs together using said strips of glue to form said hinge-lid pack having a box part and a lid part.

2. A process according to claim 1, wherein the duration of said feeding step is controlled by interrupting the supply of glue to said nozzles in accordance with the conveying speed of said blanks.

3. A process according to claim 2, wherein a pressure for expelling said glue from said nozzles is variable in accordance with the conveying speed of said blanks and decreased pressure is exerted at lower conveying speeds.

4. A process according to claim 1, wherein a pressure for expelling said glue from said nozzles is variable in accordance with the conveying speed of said blanks and decreased pressure is exerted at lower conveying speeds.

5. A process according to claim 1, wherein when the process is started up, glue is fed to said nozzles in a pulsed, cyclical manner until a minimum conveying speed is attained by pulsed, cyclical opening and closing of a valve in a glue supply line to said nozzles.

6. Apparatus for manufacturing hinge-lid packs for cigarettes, each said pack being made from a blank having a pair of inner box side tabs on opposite sides of said blank, a pair of outer box side tabs on opposite sides of said blank, a pair of inner lid side tabs on opposite sides of said blank and a pair of outer lid side tabs on opposite sides of said blank, the apparatus comprising:

a conveyor for conveying said blanks along a conveying path;

a set of nozzles disposed on each of opposite sides of said conveying path, each said set including two glue nozzles spaced apart transverse to said conveying path and directed upward for applying glue onto surfaces passing over said nozzles in contact therewith, said blanks being conveyed with said tabs disposed over said glue nozzles as glue is fed from said nozzles;

a pressing mechanism for pressing said tabs into contact with said glue nozzles so as to effect the application by said glue nozzles of two narrow, continuous and parallel strips of glue onto said outer box side tabs and said outer lid side tabs;

a glue supply line for each of said sets of nozzles; and a valve mechanism for individually shutting off each said glue supply line.

7. An apparatus according to claim 6, wherein said pressing mechanism comprises an elongate, elastic pressure-exerting plate on each side of said conveying path in the vicinity of said glue nozzles.

8. An apparatus according to claim 7, wherein said plates are disposed to form an acute angle with guide rails flanking said conveying path and said tabs enter said acute angle between said plates and said guide rails.

9. An apparatus according to claim 6, further comprising a checking station disposed in said conveying path downstream of said glue nozzles for checking the pattern of glue applied to said tabs, said checking station including a pair of legs forming a U-shaped passage through which said blanks are conveyed and an inductive sensing device for detecting said strips of glue.

* * * * *